United States Patent [19]

Gotisar

[11] Patent Number: 4,823,114

[45] Date of Patent: Apr. 18, 1989

[54] FLAME SCANNING SYSTEM

[75] Inventor: Ted Gotisar, Sparks, Nev.

[73] Assignee: Coen Company, Inc., Burlingame, Calif.

[21] Appl. No.: 557,562

[22] Filed: Dec. 2, 1983

[51] Int. Cl.[4] ..... G08B 17/12

[52] U.S. Cl. ..... 340/578; 431/24

[58] Field of Search ..... 340/578; 431/24, 25, 431/26

[56] References Cited

U.S. PATENT DOCUMENTS

| | | | |
|---|---|---|---|
| 3,307,608 | 10/1965 | Cowan | 340/578 |
| 3,709,615 | 1/1973 | Blakeslee et al. | 356/227 |
| 3,775,762 | 11/1973 | Trumble | 340/578 |
| 4,168,125 | 9/1979 | Wetmore et al. | 356/227 |
| 4,280,184 | 7/1981 | Weiner et al. | 340/578 X |
| 4,319,229 | 3/1982 | Kirkor | 340/577 X |

*Primary Examiner*—Joseph A. Orsino
*Assistant Examiner*—Jeffrey A. Hofsass
*Attorney, Agent, or Firm*—Townsend and Townsend

[57] ABSTRACT

A flame scanning system for monitoring a combustion process by detecting flame emission characteristics in the ultraviolet light spectrum. A metered relative flame intensity signal, flame-off signal, and flame-on signal are provided. A self-diagnostic feature produces a flame marginal signal indicative of substandard flame operation; a tube marginal signal indicative of imminent UV tube failure is also produced. A scanner shutter mechanism includes a check failure feature for detecting UV tube failure. An electronic assisted sighting indicator is also included to assist during on-sight scanner positioning and to provide optimum scanner placement.

7 Claims, 6 Drawing Sheets

FLAME SCANNING SYSTEM

BACKGROUND OF THE INVENTION

1. Field of the Invention

The present invention relates to the detection of gas and flames produced during a combustion process. More particularly, the present invention relates to the detection of gas and oil flames with emission characteristics in the ultraviolet light spectrum from 1,850–2,600 angstroms.

2. Description of the Prior Art

It is known to monitor flames produced during a combustion process to detect emissions in the ultraviolet (UV) light spectrum. Generally, wavelengths of 1,850–2,600 angstroms are monitored with ultraviolet detection tubes which operate on the principle of the Geiger Muller tube.

Most UV detector tubes consist of a helium-filled, glass enclosure containing parallel tungsten electrodes. A high voltage DC source is applied across the tungsten electrodes. Whenever the tungsten electrode is struck by an ultraviolet photon with an energy level in excess of the photoelectric work function of tungsten, the electrode emits an electron.

Each photon produces the emission of one electron that is amplified to an electronically detectable level by helium in the UV tube as follows: The high voltage differential between the electrodes accelerates the freed electron to the opposite electrode; the freed electron collides with helium molecules in the process of acceleration. With each collision, an additional electron is freed and this electron is also accelerated toward the opposite electrode, in turn striking additional molecules of helium and producing a chain reaction referred to as a Townsend Avalanche. As a result, the UV tube alternately conducts and quenches as ultraviolet photons strike the tungsten electrodes. In this way, a pulse train is generated having a repetition rate proportional to the emissions in the ultraviolet spectrum from the monitored flame.

As tubes age, they exhibit a gradually increasing tendency to produce an output signal in the absence of ultraviolet radiation. Such false output distorts the results obtained for the process monitored. Thus, unreliable results are produced, often defeating the purpose for which monitoring was intended, and in some cases exacerbating the problems attendant with controlling the process.

An aging ultraviolet tube eventually fails. If a critical combustion process is being monitored for flame activity, appropriate flame control may not be provided. Accordingly, the combustion process can either run away or become extinguished, producing dangerous and damaging results.

SUMMARY OF THE INVENTION

The present invention is a flame scanning system for detecting the emission characteristics of flames produced by a combustion process. The described embodiment of the invention is used to detect gas and oil flames having emission characteristics in the ultraviolet light spectrum in a range from 1,850–2,600 angstroms. "Flame off" and "flame on" signal indication is provided such that the process is reliably monitored for flame activity. Self diagnostic features are also included.

The present invention provides novel self checking and advisory signals. One such signal is a "flame marginal" signal that indicates that the flame, although not off, is not operating within an optimum range. Another such signal is a "tube marginal" signal that provides local and remote indication of the reliability of the UV tube which is used to sample flame activity.

Signal processing is accomplished by integrated circuitry to provide reliability, accuracy, and immunity to noise in harsh industrial environments. Circuit diagnostics warn a combustion process operator of unstable flame conditions, impending UV tube failure, and actual UV tube failure. The marginal flame alarm gives the process operator advance warning of the flame going out. Thus, ample time is provided for effecting burner readjustment. In a gas burner environment, such advance warning is a critical safety feature that may prevent unburned gas from accumulating and possibly exploding.

One aspect of the invention monitors the aging process of the UV tube by providing a check cycle. The process operator is alerted when it is necessary to replace the UV tube prior to actual tube failure. A mechanical shutter, used when scanning the flame, is coupled to detect a UV tube flame signal report coincident with the shutter being closed and to provide a corresponding check failure alarm. In the event a tube is not replaced when a marginal indication is provided, actual tube failure is subsequently detected and reported.

The preferred embodiment also provides a front panel indication of flame on, marginal flame, flame off, check failure (failed UV tube) marginal tube, and the check cycle in progress. A panel meter provides an indication of relative flame strength. All such indications are available for remote indication via remote reporting terminals.

Flame scanning is accomplished with a UV tube and shutter combination located in a viewing head. The invention includes an electronically assisted sighting indicator that simplifies flame sighting in single and multiple burner installations.

Accordingly, there is provided a flame scanning system including novel diagnostic, monitoring, and sighting features. The system provides advance warning of UV tube failure, as well as advance warning of a flame failure. Additionally, an electronically assisted sighting indicator is provided to optimize scanning system flame sighting. In this way, an oil or gas fired burner is reliably monitored under all conditions. The burner is readily monitored for operation in an efficient and safe manner. System operating cost is reduced by improved efficiency; down time due to failure to report marginal equipment or marginal process operation is also reduced.

DETAILED DESCRIPTION OF A PREFERRED EMBODIMENT

The preferred embodiment of the present invention uses a Geiger Muller type tube to detect the presence of ultraviolet in a flame produced by a combustion process. Operation of UV sensor tube 14 (shown in FIG. 1) is discussed in detail above; such operation generates a pulse train by an alternate quenching and conduction within the tube. The pulse train is produced at a repetition rate that is proportional to the quantity of ultraviolet emission from the monitored flame 12.

Figure 1:
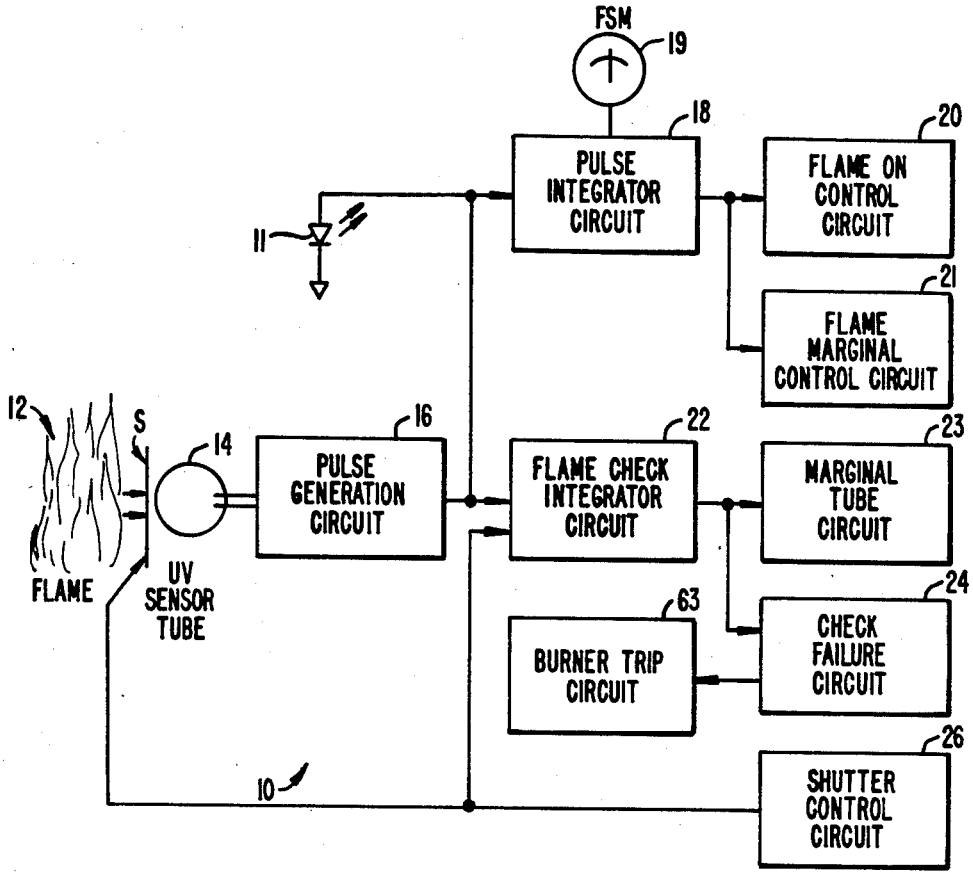
FIG. 1 is a simplified block diagram of the preferred embodiment of the present invention.

A block diagram of the preferred embodiment is shown in FIG. 1. When a sufficient quantity of pulses are detected by UV sensor tube 14, a pulse generation circuit 16 is driven to operate various reporting circuits. For example, when a sufficient number of pulses are presented to pulse integrator circuit 18, flame-on control circuit 20 is operated to report a flame-on condition.

Pulse integrator circuit 18 also operates a field strength meter 19 that indicates relative flame intensity. Flame marginal control circuit 21 also is operated by pulse integrator circuit 18 to detect marginal flame operation. When a sufficient level of flame activity is detected, flame marginal control circuit 21 turns off a flame marginal indicator. Accordingly, when the detected level of flame activity is reduced, flame marginal control circuit 21 reactivates the flame marginal indicator.

Figure 6:
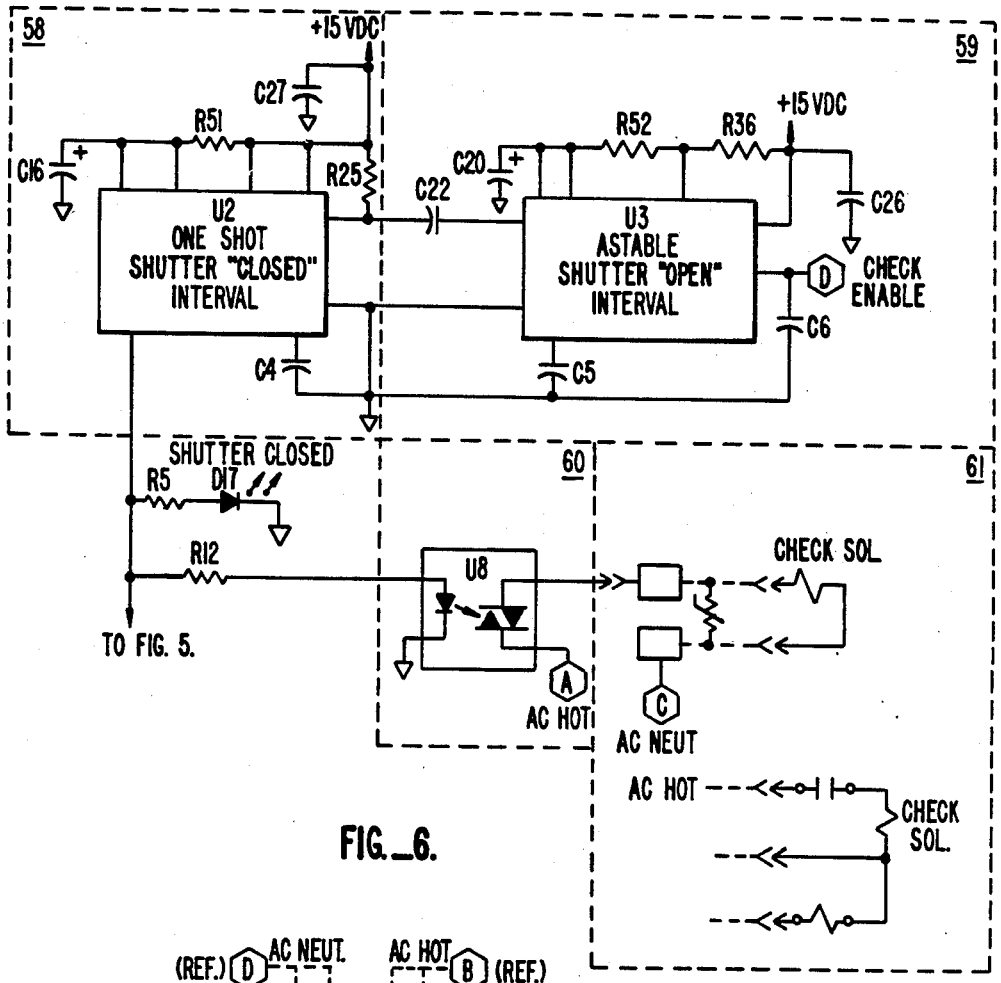
FIG. 6 is a schematic diagram of a preferred shutter control circuit.
Figure 7:
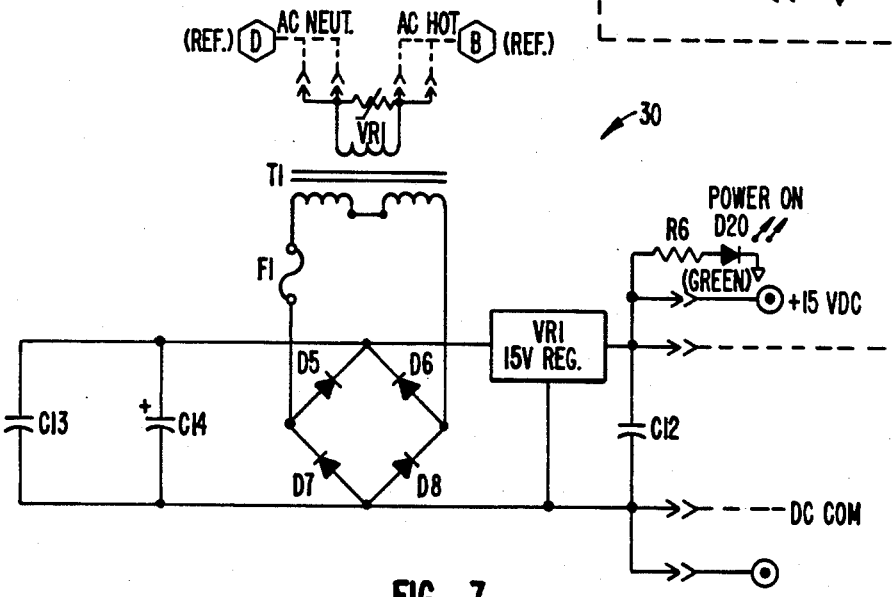
FIG. 7 is a schematic diagram of a preferred low voltage power supply.

A flame check integrator circuit 22 is coupled to receive pulses from pulse generator circuit 16 and to accordingly control marginal tube circuit 23 and check-failure circuit 24. A mechanical check of the ultraviolet tube's reliability occurs whenever a flame is detected. When a shutter solenoid (CHECK SOL., FIG. 6) is operated to block the reception of ultraviolet energy at ultraviolet tube 14 with a shutter S, a background count is detected, as "flame" ultraviolet energy is no longer received. A nominal background count produces approximately five pulses per minute in the preferred embodiment of the invention; this count increases as the UV tube ages. Shutter S may be closed on an order of two seconds to determine if any pulses are received due to normal background radiation or if too many pulses are received, which indicates a "check failure". A check failure is either an indication of tube failure or of shutter failure.

Additionally, a detected pulse level below that which is indicative of UV tube failure, but considerably higher than a normal background count, may indicate incipient tube failure. Marginal tube circuit 23 also provides such indication. It should be appreciated that shutters of the type described herein are well known in the art and may be of any type operable to block reception of flame ultraviolet energy at the UV tube.

Shutter control is accomplished by a shutter control circuit 26. Energization of a shutter solenoid occurs once approximately every sixty seconds in the preferred embodiment of the invention. In this way, the UV tube is regularly blocked from exposure to ultraviolet radiation to allow system diagnostics to be performed.

Figure 2:
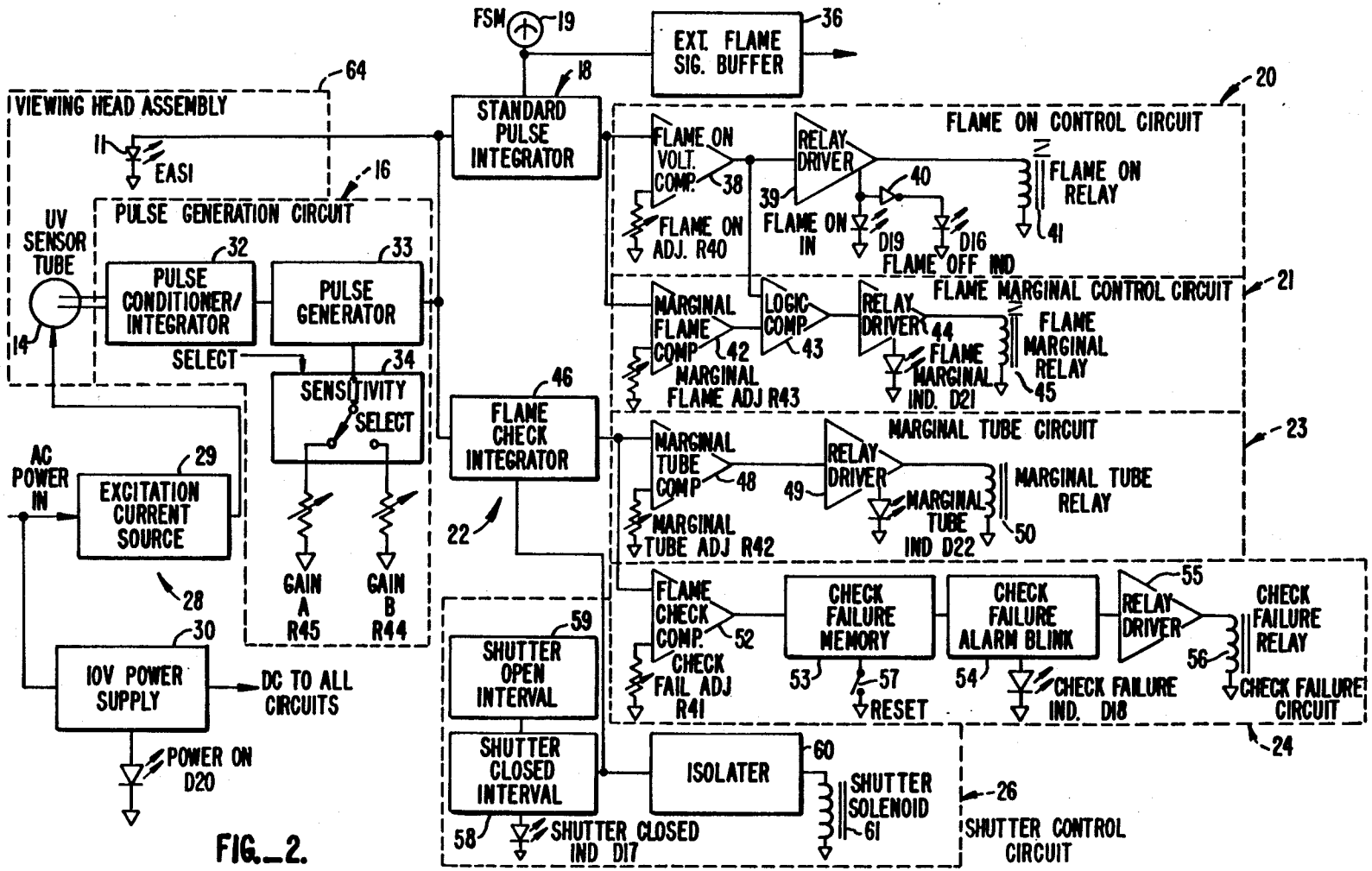
FIG. 2 is a block schematic diagram of the preferred embodiment.
Figure 3:
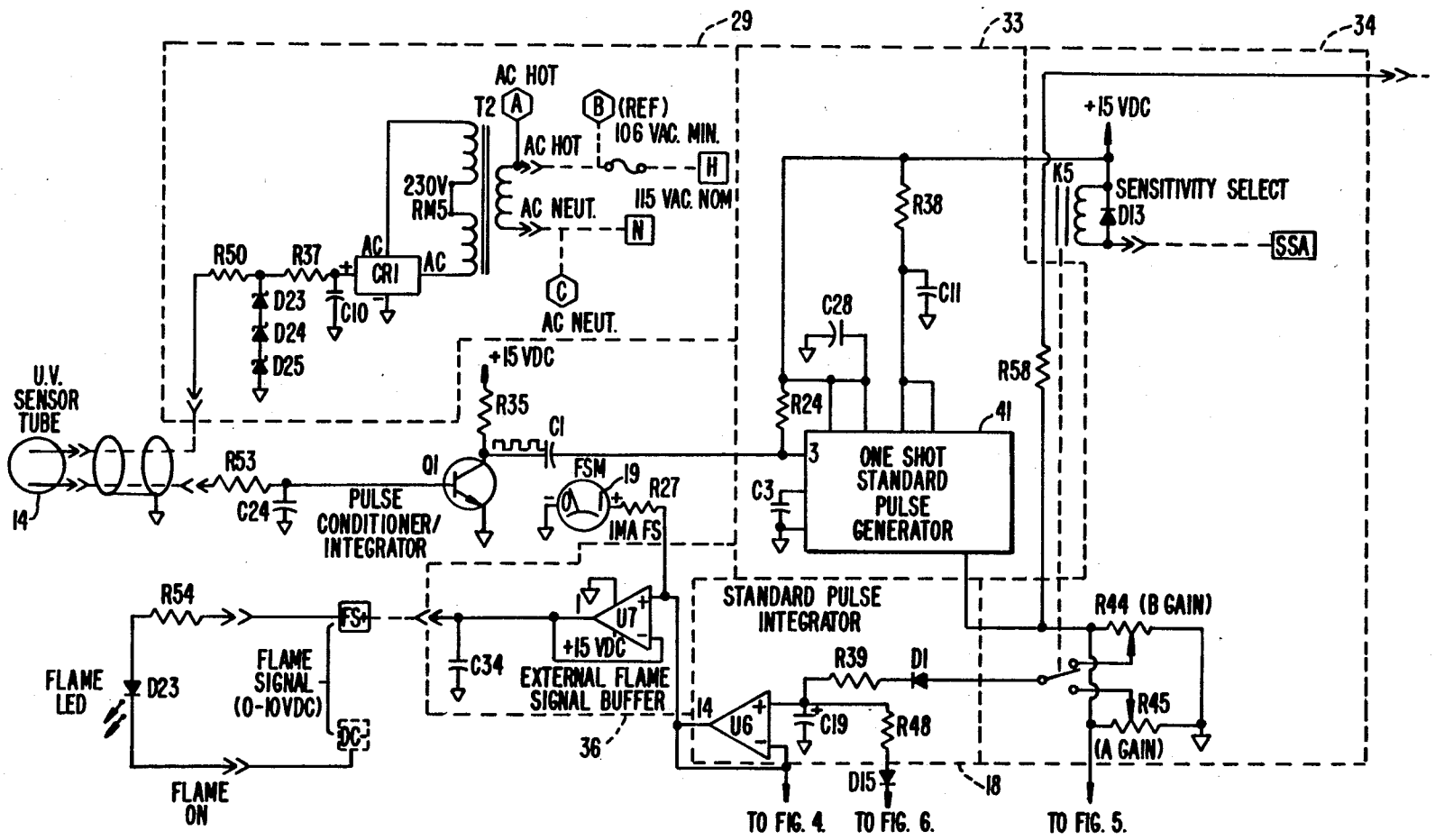
FIG. 3 is a schematic diagram of a preferred pulse generation circuit.

In FIG. 2, a block schematic diagram of a preferred embodiment of the present invention, UV sensor tube 14 is shown producing a pulse train output that is coupled to pulse generation circuit 16. A pulse conditioner-/integrator 32 and a pulse generator 33 are included in pulse generator circuit 16. Pulse generator 33 is operable at either of two provided user sensitivities, as provided by user sensitivity select circuit 34 and adjusted by gain "A" control R45 and gain "B" control R44. It should be appreciated that any number of sensitivity select controls may be provided and that the invention is not limited to only two such controls. Nor is more than one control required.

To provide a pulse output from UV sensor tube 14, a high voltage excitation current source circuit 29 couples a high voltage to the UV sensor tube, exciting the tube, and producing an output pulse stream. Power supply circuit 28, in addition to providing excitation current source 29, also provides a low voltage DC power supply 30 that operates the present invention. A power on indicator D20 is included to show circuit operation.

Figure 8:
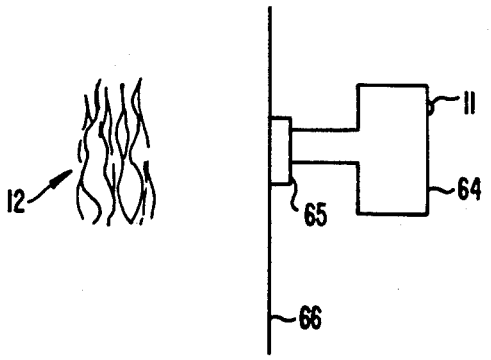
FIG. 8 is a schematic diagram of a preferred viewing head assembly.

The output of pulse generation circuit 16 is coupled to an electronically assisted sighting indicator (EASI) 11 that consists of a light emitting diode (LED) mounted on a viewing head assembly 64 (FIG. 8), in a manner making the LED visible to a system operator. The electronically assisted sighting indicator produces a repeating pulse at a rate typically from 1–5 pulses per minute for low flame radiation levels to 10–25 pulses per minute for high flame radiation levels. The flashing rate of the LED provides the operator with an indication of relative flame intensity and accordingly simplifies viewing head sighting adjustments at the process front. Although a viewing head is mentioned, the disclosure herein is considered sufficient to describe the claimed invention without showing the viewing head—viewing heads are well known in the art.

The output of pulse generation circuit 16 is also coupled to standard pulse integrator circuit 18. The integrated signal is used to operate relative field strength meter 19 and to drive an external flame signal buffer 36, such that a remote relative field strength indication may be provided. Standard pulse integrator circuit 18 also operates flame-on control circuit 20 and flame marginal control circuit 21.

Flame-on control circuit 20 receives an integrated pulse signal at a flame-on voltage comparator 38. Comparator 38 compares the integrated signal from the standard pulse integrator circuit with a reference level controlled by flame-on adjust control R40. An output signal produced by flame-on comparator 38 is coupled to a relay drive 39 that operates a flame-on relay 41 when a flame-on condition is detected. A flame-on condition is indicated by flame-on indicator D19. The flame-on signal also is inverted by an inverter 40 and the inverted signal is used to operate a flame-off indicator D16.

Flame marginal control circuit 21 receives an integrated pulse signal at a marginal flame voltage comparator 42. The marginal flame level is compared with a reference level determined by a marginal flame adjust control R43. An output signal produced by marginal flame voltage comparator 42 is coupled to a logic comparator circuit 43 where the signal is compared with the flame-on signal produced by flame-on comparator 38. A flame-on signal inhibits operation of the flame marginal indicator and, likewise, the absence of a flame-on signal allows operation of the flame marginal indicator. An output signal produced by logic comparator 43 is coupled to relay driver 44 and operates flame marginal relay 45 to provide indication of a marginal flame condition. Flame marginal indicator 21 provides a visual report of the flame marginal condition.

The pulse stream output from pulse generator circuit 16 is also coupled to flame check integrator circuit 22 that includes a flame check integrator 46. The output from flame check integrator 46 is coupled to a marginal tube circuit 23 and check failure circuit 24.

Marginal tube circuit 23 includes a marginal tube comparator 48 that receives the integrated pulse stream from flame check integrator 46 and that compares the pulse stream with a reference level established by marginal tube adjust control R42. The output from marginal tube comparator 48 is coupled to the relay driver circuit 49 and operates marginal tube relay 50, to indicate a marginal tube condition. A marginal tube indicator D22 is also provided.

Check failure circuit 24 receives the integrated pulse stream from flame check integrator 46 at a flame check comparator circuit 52 and compares the pulse stream with a reference signal adjusted by a check failure adjust control R41. An output signal produced by flame check comparator 52 is coupled through a check failure memory 53 and check failure alarm blink circuit 54 to a relay driver circuit 55. Check failure memory 53 is provided with a reset control 57 in the event a reported failure is subsequently corrected. Relay driver 55 operates check failure relay 56 to provide indication of a tube failure condition. A check failure indicator D18 is also provided.

Shutter control circuit 26 includes a shutter closed interval circuit 58 and a shutter-open interval circuit 59 for control of shutter operation. A shutter-closed condition is indicated by shutter-closed indicator D17. The output of shutter-closed interval circuit 58 is coupled to an optoisolator circuit 60 which drives an internal triac and is used to operate shutter solenoid 61. Shutter control circuit 26 is coupled to flame check integrator 46 so that, when shutter S is closed, flame check integrator 46 will pass its integrated pulse stream signal to marginal tube circuit 23 and check failure circuit 24.

A schematic diagram showing a preferred embodiment of the present invention is provided by FIGS. 3–7. Operating power (in this embodiment 115 volts AC) is provided as excitation to step-up transformer T2 (FIG. 3), which is part of UV excitation current source circuit 29. Transformer T2 can also be operated at 230 volts AC, as desired, by changing a tap on the transformer secondary winding. Voltage output from the transformer's secondary winding is full-wave rectified by rectifier CR1 and maintained at 300 volts DC by zener diodes D23–D25. The regulated DC voltage provides excitation current of approximately one milliampere to UV sensor tube 14; the amount of excitation current is limited by resistor R50.

UV tube exposure to ultraviolet radiation at a flame front causes the tube to ionize and conduct current. Nonperiodic discharge of the UV tube produces a nonperiodic pulse train. The average pulse repetition rate is a function of UV radiation intensity. A current representative of these pulses is provided to the base-emitter junction of a pulse condition transistor Q1, triggering the transistor "on" in response to the discharge pulse from the ultraviolet tube. A square wave signal is thereby generated at the collector of transistor Q1. The square wave signal is differentiated by a capacitor C1 to provide a triggering pulse to one-shot multivibrator circuit U1.

For each discharge of the ultraviolet tube, a single standard pulse of energy is provided at pin 3 of multivibrator circuit U1. Pulses produced by multivibrator U1 are integrated by the standard pulse integrator circuit which consists of a capacitor C19, a resistor R39, and a buffer amplifier U6-14 (the number "14" refers to an output pin number for the device). As a result, a DC control signal is produced that is proportional to detected flame intensity.

Variable resistors R44 and R45 are user adjustable sensitivity controls that may be located on a front panel portion (not shown) of the present invention. Each gain control, as selected by operation of a relay K5, changes the amplitude of standard pulses at the input to the standard pulse integrator circuit. Relay K5 may be operated by any sort of switching device such as a transistor.

A DC level signal produced by integration of the constant energy pulses is coupled to buffer amplifier U6-14. A DC voltage output signal produced by buffer amplifier U6 is coupled to 1 milliampere full-scale meter FSM via a resistor R27. The meter may be mounted on the front panel (not shown) of the present invention to provide continuous indication of relative flame level.

Buffer amplifier integrated circuit U7 is an external flame signal buffer and provides remote flame signal indication at a magnitude similar to that of DC level circuit U6-14. External flame signal buffer U7 has a low output impedance for driving devices such as remote signal meters or strip chart recorders. The external flame signal buffer prevents oscillation induced by external circuitry that could otherwise degrade operation or cause circuit loading.

As discussed above, a light emitting diode 11 is included to assist a user when performing boiler front sightings and adjustments. Light emitting diode 11 is driven directly by the output of multivibrator circuit U1 through a resistor R58.

Figure 4:
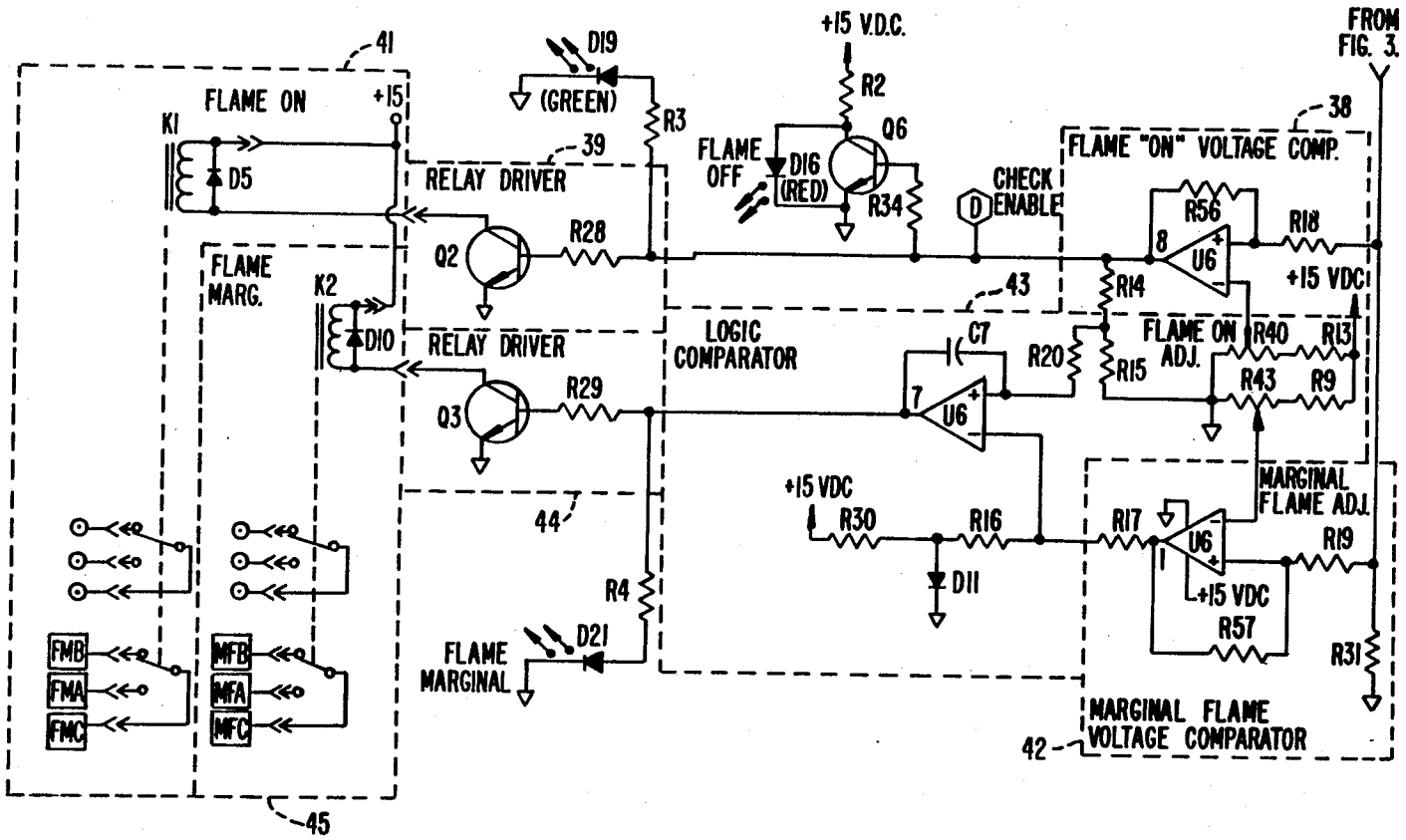
FIG. 4 is a schematic diagram of a preferred signal and condition reporting circuit.

Operation of the "flame-on" and "flame marginal" relays is shown in FIG. 4. Signals are derived from integrated circuits U6-8 and U6-1 which are configured as voltage comparators. Each voltage comparator includes an adjustable reference voltage coupled thereto via voltage divider variable resistors R40/R43. The same DC voltage that is produced by voltage follower U6-14 (representing flame intensity) is directed to the input of "flame-on" and the "marginal flame" voltage comparators U6-8 and U6-1. The output of the voltage comparators switches from 0–15 volts when the reference voltage is compared and the threshold for a given condition is thereby detected. The output voltage produced drives relay driver transistors Q2 and Q3 and operates "flame-on" and "flame marginal" relays (K1 and K2). Light emitting diodes D16, D21, and D19 provide front panel indication of the prevailing comparator state.

Figure 5:
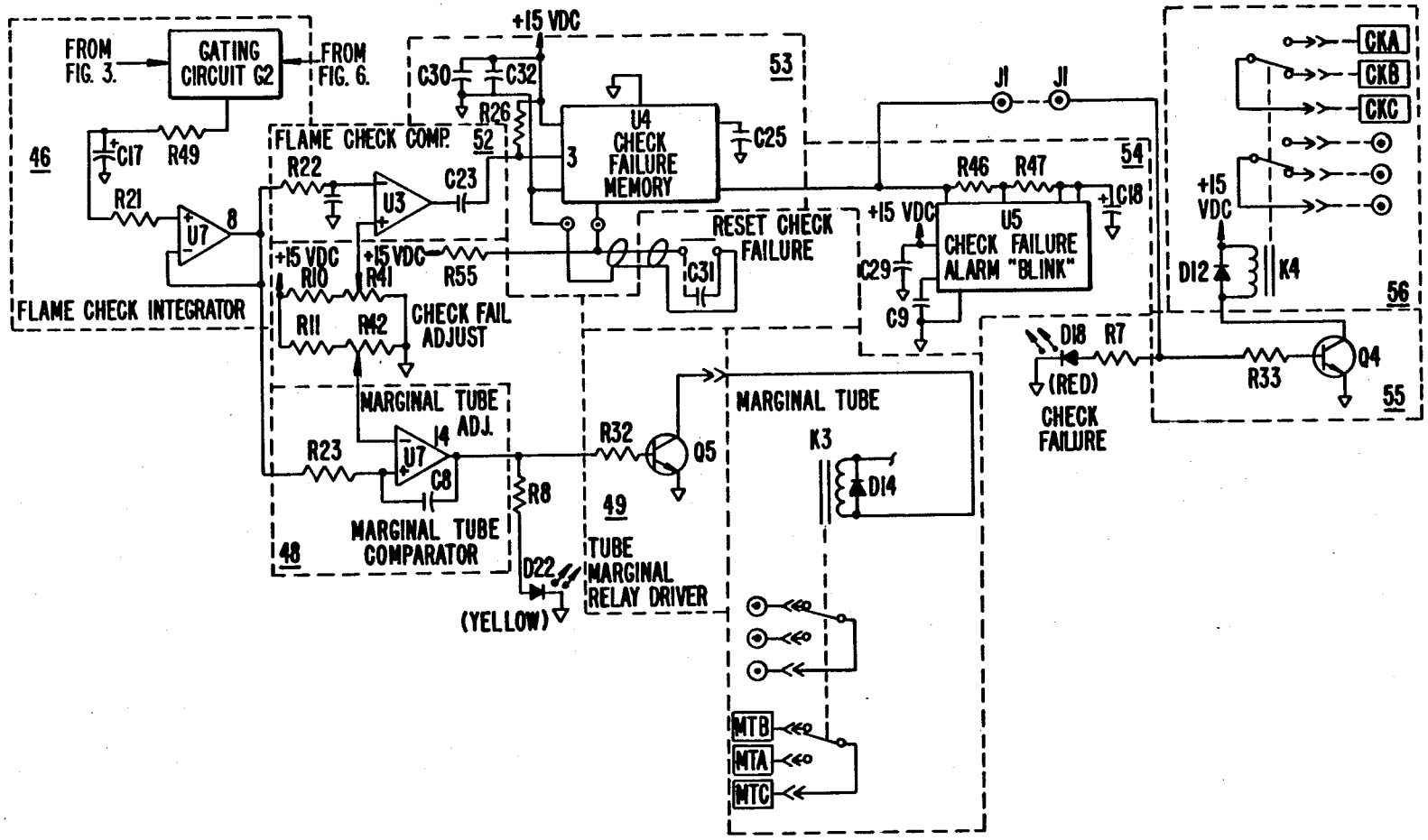
FIG. 5 is a schematic diagram of a preferred flame check and tube marginal circuit.

Integrated circuit U7 is shown in FIG. 5. Circuit U7 provides a check during the shutter-closed interval to detect the presence of a signal output from the standard pulse generator U1. The presence of such a signal indicates either a malfunctioning UV sensor tube or shutter mechanism. Protection is provided against a "flame-on" indication that does not represent the actual presence of flame. A capacitor C17, a resistor R49, a gating circuit 62 and an integrated circuit U7-8, configured as a voltage follower, form flame check integrator 46. Gating circuit 62 isolates the flame check integrator capacitor C17 from standard pulse generator U1 during the time between check intervals. Integrated circuits U3 and U7-14 are a flame check voltage comparator and a flame comparator, respectively. Each of these voltage comparators compare the output of the flame integrator with a reference voltage. The reference voltage is derived from a voltage divider network including variable resistors R41 and R42. Each voltage divider is adjustable to allow marginal tube or flame check failure threshold levels to be established by comparison with a suitable standard, e.g. during factory calibration.

A rapid change of state takes place when the signal applied to flame check comparator U3 crosses a reference threshold. An output signal is produced by comparator U3 that is differentiated by a capacitor C23 and resistor R26 resulting in a pulse that sets check failure memory U4 (which is an RS flip flop). When check failure memory U4 is set by a check failure signal, an output signal provided at pin 3 undergoes a transition to a high state. In this state, the signal activates check failure alarm relay K4.

Integrated circuits U2/U3 (shown in FIG. 6), together with associated RC networks including capacitors C16/C20 and resistors R51/R52 form a timing circuit that establishes an interval between shutter closures and the duration of each shutter closure. These timing values are nominally a function of the circuit values chosen for the RC network components shown in FIG. 5 and provide a one second shutter closure once per minute in the exemplary embodiment of the invention. Values may be selected as desired. A signal produced by the timing circuit is used to energize integrated circuit U8 which is an optically coupled triac. The output of circuit U8 drives a solenoid (CHECK SOL.) that actuates the shutter mechanism in the viewing head (not shown).

The preferred embodiment of the invention operates according to the following specifications:

(1) Supply Voltage: 105–135 volts, 60 Hz., 30 VA.

(2) Output Contacts: Flame off, flame on, marginal tube, marginal flame, and check failure.

(3) Contact Rating: 0.5 amps at 125 volts AC; 2.0 amps at 30 volts DC.

(4) User Adjustments: Gain level A adjust, gain level B adjust.

(5) Shutter Interval: Standard one per minute, adjustable according to time constant selected.

(6) Flame Failure Response Time: Nominally four seconds, adjustable.

(7) Output Signal: 0–13 volts relative to flame level.

(8) Front Panel Indication: Relative flame level, flame on, flame off, marginal flame, check fail, marginal tube, and check-in-progress.

The following relay contacts are provided as shown in FIG. 5:

CKA=check failure (normally open)
CKB=check failure (normally closed)
CKC=check failure (common)
MSA=marginal flame (normally open)
MSB=marginal flame (normally closed)
MSC=marginal flame (common)
FMA=flame on (normally open)
FMB=flame on (normally closed)
FMC=flame on (common)
MTA=marginal tube (normally open)
MTB=marginal tube (normally closed)
MTC=marginal tube (common)
H=110 volts hot lead
N=110 volts neutral lead
T=standard tube
SH=shutter hot
SN=shutter neutral
SF+=flame signal meter
EASI=connection to electronic assisted sighting indicator
SAA=selected sensitivity A (input)
DC(−)=DC (common)

In operation, the combustion process to be scanned for flame radiation is monitored by the present invention. A typical viewing head 64 (FIG. 8) is provided with a ball and socket mount 65 to aid in the adjustment of the scanning equipment. The viewing head should be mounted 1–2 feet radially on the center line of the burner 66 or process monitored. On multiple burner boilers, the viewing head should be located so that when sighted on the burner in question, it is aimed away from adjacent burners. In this way, interference between the burners is prevented.

When scanning igniters that are mounted off-center in a wind box, the scanner should be located at or near the same radial distance from the center line. It is important that the direction of burner swirl be determined and that the scanner be located downstream of the igniter and within 90° of the igniter.

When sighting the present invention, it is important to remember that the scanner is sensitive to the ultraviolet spectrum which is not visible to the human eye. Therefore, sighting the scanner on the brightest visible part of the burner flame may not be the highest source of UV radiation. Recognizing this problem, the present invention not only provides the electronically assisted viewing indicator 11 on the sighting head, but also provides a flame intensity meter that may be used during sighting to determine the area of the flame with highest ultraviolet radiation. It is important to check the sighting of the scanner at all loads since flame characteristics may vary at different firing rates. Optimum sighting gives the highest average reading under all conditions.

The two adjustable gain controls are provided for user adjustment. In the preferred embodiment of the invention gain control "B" is always active unless gain control "A" has been selected by an actuating signal at an external contact. The two gain controls allow separate adjustments for use when two fuels are burned. The external gain select can be operated by a burner control system upon fuel transfer. Gain should be adjusted on each control at a low position to approximately 60% of full scale reading on the fuel strength meter. At maximum firing rate, the meter should be read at or near full scale.

In all flame scanning systems, one component that often requires service is the ultraviolet tube. When the marginal tube alarm is actuated, it is time to replace the ultraviolet tube. If replacement is delayed for a long interval, the check failure alarm will activate. In some installations, it may be desirable to connect the present invention in a burner management system such that the check failure alarm activates a burner trip circuit 63 (FIG. 1), which shuts off the supply of fuel to the burner. In this way, a combustion process will not be carried out in a blind manner. Generally, the marginal flame alarm is an indication that the fuel/air ratio or burner register needs adjustment. If the marginal flame alarm is activated after the burners have been adjusted, it is possible that the ultraviolet tube lens needs adjustment or cleaning.

The foregoing was given for purposes of illustration and example. It should be appreciated by those skilled in the art that the present invention is capable of production in various equivalent embodiments. For example, additional sensitivity adjustments may be provided, shutter interval adjustments may be provided, the relays may be replaced with electronic switches if appropriate, and the present invention may be interfaced to a microcomputer which is part of a burner management system and which serves to automatically coordinate the operation of a burner system. Therefore, the scope of the invention should be limited only by the claims.

I claim:

1. Flame scanning apparatus for monitoring the flame level of a burner, comprising:

a viewing head assembly adjustably mounted in proximity to the burner so as to receive electromagnetic radiation emitted from a flame produced by the burner;

a sensor disposed in said viewing head assembly, which responds to radiation in a predetermined range of the electromagnetic spectrum by emitting a signal corresponding to the amount of radiation detected in said range;

means for adjusting the position of said viewing head assembly so as to optimize the detection of radiation in said range by said sensor;

indicator means responsive to said signal, and located proximate to said viewing head assembly so as to be perceivable by an operator while adjusting said viewing head assembly, for producing an intermittent indication at a frequency reflective of the intensity of radiation in said predetermined range detected by said sensor.

2. Apparatus according to claim 1, wherein said indicator means comprises light emitting means located within viewing range of said operator, and said intermittent indication comprises a flashing light from said light emitting means.

3. Apparatus according to claim 1, wherein said intermittent indication is produced at a frequency which increases in response to an increase in the intensity of radiation in said predetermined range detected by said sensor.

4. Apparatus according to claim 3, wherein said indicator means comprises light emitting means located within viewing range of said operator, and said intermittent indication comprises a flashing light from said light emitting means.

5. Apparatus according to claim 2, wherein said light emitting means is mounted on said viewing head assembly.

6. Apparatus according to claim 1, wherein said sensor comprises ultraviolet radiation detecting means for emitting electrical pulses at a frequency corresponding to the amount of ultraviolet radiation detected.

7. Apparatus according to claim 6, wherein said indicator means comprises light emitting means located within viewing range of said operator, and said intermittent indication comprises a flashing light from said light emitting means at a frequency directly proportional to the frequency of said electrical pulses from said detecting means.

* * * * *